United States Patent [19]

Tonus

[11] Patent Number: 4,674,270

[45] Date of Patent: Jun. 23, 1987

[54] APPARATUS FOR BANDING CUT PRODUCE

[75] Inventor: Egidio L. Tonus, Castroville, Calif.

[73] Assignee: Calif. Artichoke & Vegetable Growers Corp., Castroville, Calif.

[21] Appl. No.: 841,980

[22] Filed: Mar. 20, 1986

[51] Int. Cl.[4] ..... B65B 25/04; B65B 13/02

[52] U.S. Cl. ..... 53/556; 53/585; 53/291; 53/298

[58] Field of Search ..... 53/291, 293, 298, 391, 53/392, 585, 556

[56] References Cited

U.S. PATENT DOCUMENTS

| | | | |
|---|---|---|---|
| 2,647,525 | 8/1953 | Duda | 53/391 X |
| 2,757,500 | 8/1956 | Heinz | 53/392 X |
| 2,882,660 | 4/1959 | Denton | 53/135 |
| 3,058,278 | 10/1962 | Bradshaw | 53/391 |
| 3,288,055 | 11/1966 | Vellrath | 100/4 |
| 3,572,396 | 3/1971 | Hoffman et al. | 138/178 |
| 3,599,395 | 8/1971 | Rodriguez | 53/391 |
| 4,055,934 | 11/1977 | Leveugle | 53/585 |
| 4,095,391 | 6/1978 | Anguiano | 53/123 |
| 4,318,685 | 3/1982 | Konstantin | 425/508 |
| 4,389,834 | 6/1983 | Wysocki | 53/391 X |
| 4,401,020 | 8/1983 | Brux | 100/7 |
| 4,442,765 | 4/1984 | Limehouse et al. | 100/6 |
| 4,470,241 | 9/1984 | Parry et al. | 53/556 |
| 4,480,536 | 11/1984 | Burns | 100/6 |

*Primary Examiner*—John Sipos

*Attorney, Agent, or Firm*—Townsend & Townsend

[57] ABSTRACT

A mobile apparatus for field packing of broccoli and other cut product includes a mobile frame and a rotatable sorting table. Individual broccoli stalk cut by workers walking along with the mobile packer and placed on conveyors on the packer and are discharged onto the rotatable sorting table. A plurality of banding frames are attached to the periphery of the rotatable table and include mechanisms for holding an expanded elastic band. Workers standing around the table may gather the broccoli from the table, form bunches of individual stalks, and place the bunches into the expanded band. Further mechanisms are provided for automatically ejecting the banded broccoli onto a discharge conveyor, and replacing a new elastic band onto the banding frame. The bunched broccoli may then be packed into cartons by other personnel on the mobile packer.

20 Claims, 15 Drawing Figures

APPARATUS FOR BANDING CUT PRODUCE

BACKGROUND OF THE INVENTION

1. Field of the Invention

The present invention relates generally to equipment for bunching and securing cut produce, and more particularly, to equipment which allows the bunching, securing, and packing of cut produce to be performed in the field.

2. Description of the Background Art

Commercial agriculture has traditionally relied on harvesting and collection of produce in the field and packaging of the produce at a central packaging facility for shipment to market. While this approach is certainly workable, it suffers from a number of disadvantages including increased exposure of the produce to mechanical damage resulting from an excessive number of handling operations, and the high capital and operating costs associated with maintaining such central packaging facilities.

In order to improve both the quality of the produce and the economics of the operation, there has been a trend in recent years toward the field packing of cut produce. Such field packing generally relies on mobile packaging equipment which follows or is integrated with the harvesting equipment. Under the best circumstances, the produce is removed from the field and packaged into appropriate containers for shipment to market, and the need for a central packaging facility is entirely eliminated.

Of particular interest to the present invention are field packing systems developed for broccoli. A particular system has been developed by Salinas Valley Engineering and Manufacturing, Inc., Salinas, Calif., which system is described in U.S. Pat. No. 4,470,241. The system provides for a mobile packing unit having a fixed sorting table mounted on one end. Workers on foot cut the broccoli from the ground and throw it up onto the sorting table as the packer follows them. Additional workers sit behind the sorting table and have fixed banding frames for placing rubber bands around broccoli bunches which they put together. The banding frames include spreadable fingers, and the workers must first manually place the band around the fingers when they are collapsed together. After placing the rubber band, the pins are automatically spread on a set time schedule so that they spread apart, opening the rubber band. The broccoli bunch is then manually inserted into the opened rubber band, and the spreader pins are collapsed when the worker manually activates a release switch. The workers must then pull the broccoli from the banding frame and turn around and place the broccoli in a carton or on a conveyor which transports the bunch rearward, where it is placed in a carton.

While this system is an improvement over central packing of broccoli, it suffers from a number of disadvantages. Particularly, the banding operation performed by the workers on the mobile packer is highly inefficient, requiring the seven separate acts described above. Because of this inefficiency, it is found that each worker can band at most from 5 to 10 broccoli bunches per minute on the average. Such inefficiency decreases both the cost of harvesting and the time required for harvesting.

It would thus be desirable to provide an improved mobile packing system for broccoli and other cut produce. It would be particularly desirable to provide such a packing system capable of reducing the number of manual operations required for banding each bunch of produce.

SUMMARY OF THE INVENTION

The present invention provides an apparatus for the highly automated bunching and packing of broccoli and other cut produce. The apparatus includes a rotatable sorting table which receives a continuous stream of cut produce from a feed device, typically a conveyor. A plurality of banding frames are placed about the periphery of the sorting table and are mounted to rotate therewith. Mechanisms for placing individual bands on the banding frames and opening the bands are provided, and workers standing around the sorting table may select broccoli from the table and place it into the bands on the banding frames as the frames and the table are rotated. Mechanisms are also provided for automatically discharging the banded produce from the banding frames and for collecting the discharged produce as it is ejected. In this way, each worker need perform only a single motion in picking the broccoli from the sorting table and placing it in the banding frame. The need for the worker to manually place rubber bands on the banding frame and to manually pull the banded bunch from the banding frame is eliminated. This results in a great saving of time and money.

The sorting table and banding mechanisms just described will normally be mounted on a mobile frame for use in the field, although they might also be mounted on fixed frames for use in a central packing facility or elsewhere. When mounted on a mobile frame, the conveyor feeding the produce to the sorting table will normally extend axially to the front of the frame so that a line of workers walking in front of the mobile frame may place the cut broccoli on the conveyor. Conveniently, transverse conveyors running longitudinally outward from the axial feed conveyor will also be provided. This allows access to a large number of field workers walking just behind the conveyors. The large quantity of broccoli which may be harvested in this manner may easily be accomodated by the rotatable table banding apparatus which is designed to handle such large quantities sufficiently.

In another aspect, the present invention provides a rapid and reliable mechanism for placing individual elastic bands onto the spreader pins of banding frames as they pass. The mechanism relies on slicing bands of a preselected width from a continuous length of elastic tubing. The elastic tubing is fed past a reciprocatable blade in a direction substantially perpendicular to the direction of travel of the blade. Snagging pins are mounted on a pivotable arm, and the snagging pins are juxtaposed with the blade on the other side of the tubing when the pivotal arm is in a first position. The motion of cutting the tubing with the blade carries the cut segment of the tubing onto the pins where the segment is temporarily secured. The arm is then moved so that the elastic band is moved to a location adjacent the path of the spreader pins. As spreader pins are moved past the pivotable arm, a push-off plate ejects the band from the snagging pins onto the spreader pins.

DESCRIPTION OF THE PREFERRED EMBODIMENT

Figure 1:
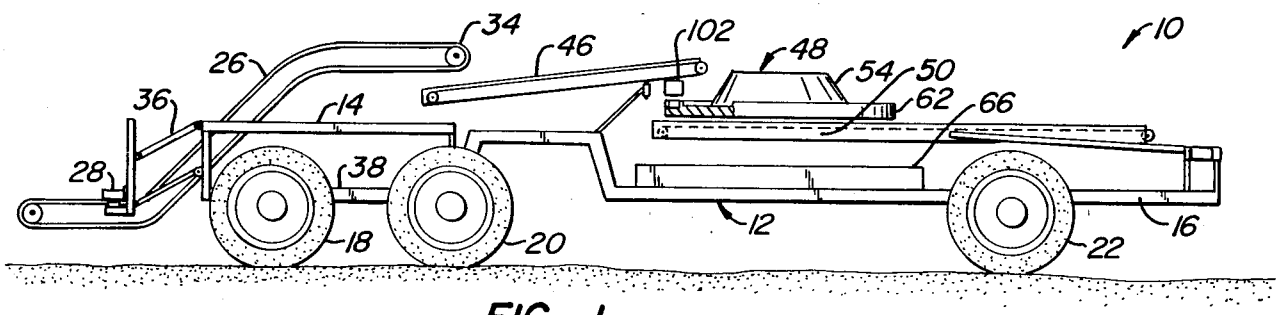
FIG. 1 is a simplified side elevational view of the mobile packer of the present invention.
Figure 2:
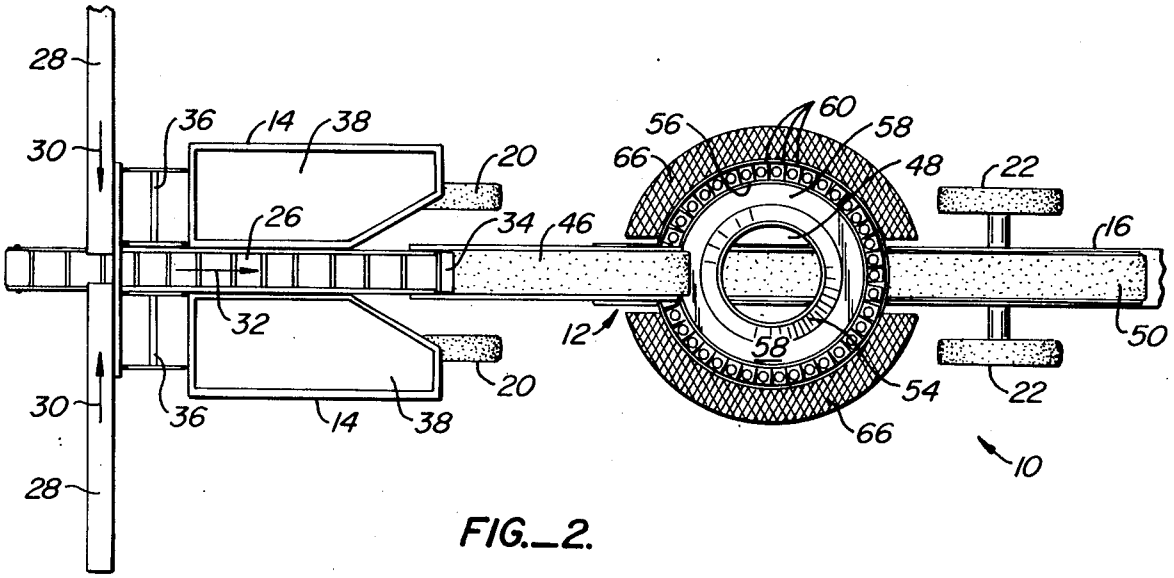
FIG. 2 is a simplified top plan view of the mobile packer of the present invention.

A mobile broccoli packer 10 constructed in accordance with the principals of the present invention is illustrated in FIGS. 1 and 2. The broccoli packer 10 includes a frame 12 which, as illustrated, is articulated, including a forward section 14 and a rearward section 16. Such articulation enhances the maneuverability of the packer 10, but is not considered necessary. Usually, the forward section 14 will be powered for self-propulsion and will include steerable wheels 18 and powered wheels 20. Conveniently, the forward section 14 of the frame 12 may be built around the chassis of a tractor or other 4-wheel drive vehicle. In order to further enhance the traction and maneuverability of the mobile frame 12, the wheels 22 on the rear section 16 will usually be powered and steerable as well.

The forward section 14 of the mobile packer 10 includes an axial conveyor belt 26 running from the forward end (to the left in FIGS. 1 and 2) of the packer 10 to a discharge location 34 over the rear end of the forward section 14 of the frame 12. A pair of transverse conveyors 28 extend transversely from the forward end of the axial conveyor 26 and are arranged to operate in the direction shown by arrows 30. In this way, workers, as they cut broccoli from the field, are able to throw the cut broccoli onto the transverse conveyors 28 which transport the cut broccoli to the axial conveyor 26. Axial conveyor 26 then transports the cut broccoli rearward (in the direction of arrow 32) to the discharge end 34.

The forward end of axial conveyor 26 and the transverse conveyors 28 are mounted on a trapezoidal support frame 36 which allows all three conveyors to be raised and lowered as necessary. For convenience, the transverse conveyors 28 are pivotably attached to the trapezoidal support frame 36 so that they may be folded back on the mobile frame 12 to facilitate transport.

A pair of work platforms 38 are provided on either side of the forward section 14 of frame 12. Typically, systems (not shown) for driving and steering the packer 10 and for powering all hydraulic systems, including the conveyors, are mounted on these platforms 38. Such systems are well known in the art, and need not be described further.

The rearward section 16 of the mobile frame 12 is attached to the forward section 14 by conventional means, such as a trailer hitch. Hydraulic power lines (not shown) are run from the forward section to the rearward section for the operation of the conveyors, the rotatable sorting table and other mechanical devices on the rearward section, as will be described hereinafter.

A second axial conveyor 46 is mounted on the forward end of the rearward section 16 so that it receives the cut produce discharged from the first axial conveyor 26. The second axial conveyor 46, in turn, discharges the cut produce onto a rotatable sorting table 48.

The discharge end 34 of first axial conveyor 26 lies directly over the pivot point between the forward and rearward sections 14 and 16 of the packer 10. In this way, broccoli will discharge onto the second axial conveyor 46 even when the packer 10 is turning and the sections 14 and 16 are articulated. Operation of the first axial conveyor 26 also continues regardless of the position of the trapezoidal support frame 36. Together, these features allow continued operation of the packer 10 as it is maneuvered around the field.

The sorting table 48 may be rotatably driven by any conventional drive assembly, such as a hydraulic motor with an appropriate gear chain (not shown). As will be described in detail hereinafter, cut broccoli is bunched and banded on the rotatable table 48, and discharged onto an axial discharge conveyor 50 beneath the rotatable table 48.

Figure 3:
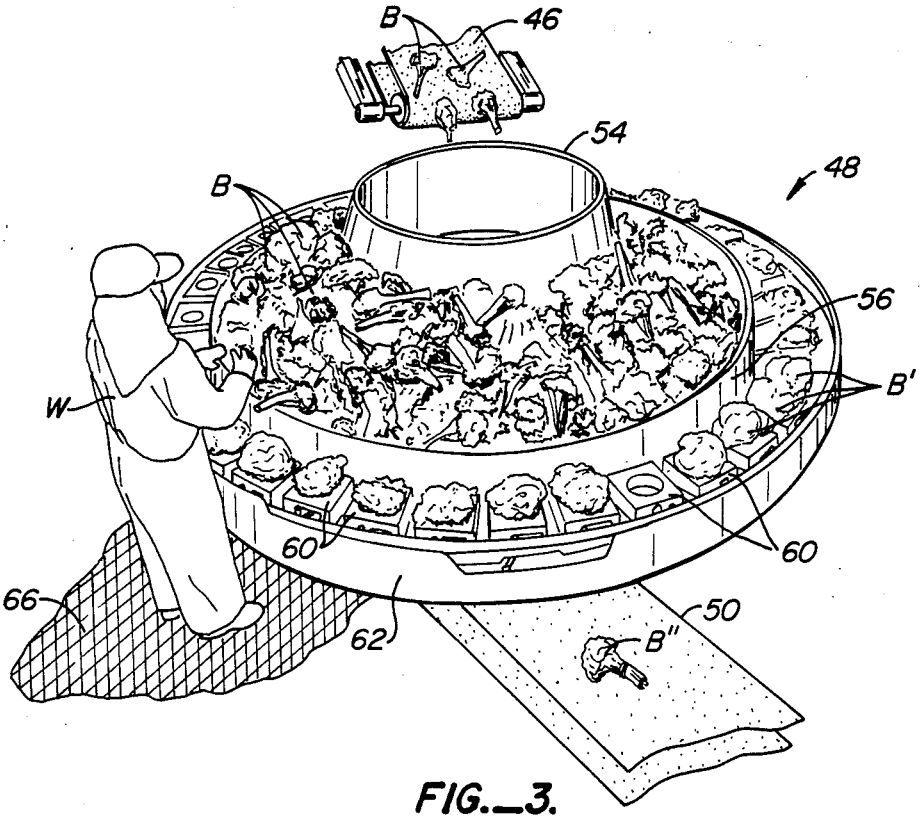
FIG. 3 is a perspective view of the rotatable sorting table of the present invention illustrating the individual banding frames mounted about its periphery.
Figure 4:
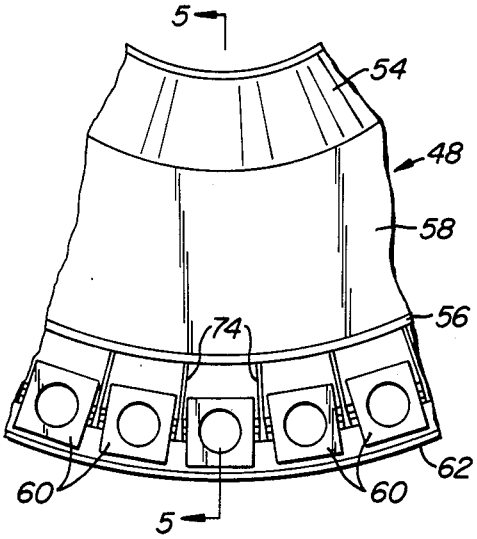
FIG. 4 is a detail view of a section of the sorting table illustrating the pivotable mounting of the individual banding frames.
Figure 5:
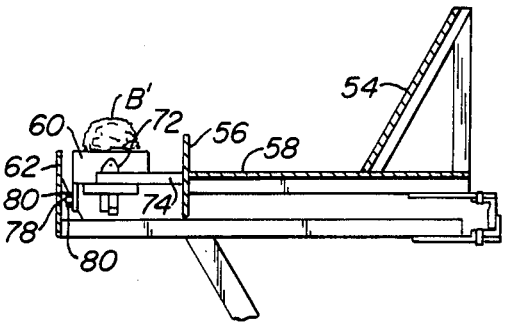
FIG. 5 is a cross-sectional view taken along line 5—5 of FIG. 4.
Figure 6:
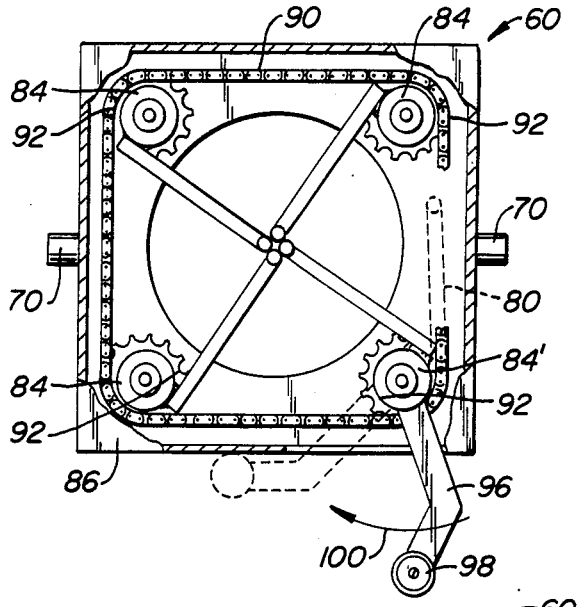
FIG. 6 is a top view of a banding frame with portions broken away to illustrate the spreadable pins which are used for opening elastic bands.
Figure 7:
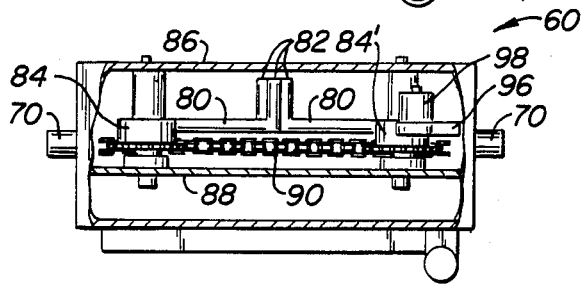
FIG. 7 is a front elevational view of the banding frame with portions broken away.

Referring now also to FIG. 3, the sorting table 48 includes a central conical wall 54 and a peripheral wall 56. A flat surface 58 extending between the conical wall 54 and peripheral wall 56 receives broccoli B as it is discharged from the second axial conveyor 46. Since the sorting table 48 rotates, the broccoli will be evenly distributed about the circular surface 58.

A plurality of banding frames 60 are distributed evenly about the peripheral wall 56 and attached thereto so that they rotate with the sorting table 48. A skirt 62 is mounted outside the banding frame 60. The skirt 62 is fixed relative to the frame 16 and does not rotate.

As is best illustrated in FIG. 3, a worker W can stand on platform 66 adjacent sorting table 48 so that the worker W has access to the broccoli B on the table. The worker W is able to select broccoli B from the table 48, form one or more of the stalks to bunches, and place the bunches B′ into the banding frames 60. As will be described in detail hereinafter, the banding frames 60 place elastic bands around the broccoli bunches B′, and discharge such banded bunches B″ onto discharge conveyor 50.

Referring now to FIGS. 4–7, the mounting and operation of the banding frames 60 will be described in more detail. Banding frames 60 include a pair of pivot pins 70 on opposite sides thereof. The pivot pins 70 are mounted in bearings 72 (FIG. 5), which in turn are mounted on radial support arms 74 attached at their remote end to the peripheral wall 56. In this way, the banding frames 60 are able to individually rotate about an axis defined through the pivot pins 70. The rotational position of the frames 60 is governed by roller 76 which is mounted on extension member 78. The roller 76 rides between a pair of rails 79 (best observed in FIGS. 12 and 13) which rotate the banding frames 60 upside down to facilitate discharging the banded broccoli therefrom, as will be described in greater detail hereinafter.

Each banding frame 60 includes a plurality of spreadable arms 80, each of which terminates at its distal end in a bent or hooked portion 82. The arms 80 are each attached at the other end to a cylindrical member 84 which is rotatably mounted between top plate 86 and bottom plate 88. Rotation of the cylinders 84 is synchronized by a chain 90 which runs over sprockets 92 formed on each cylinder 84. One of the cylinders 84' further includes a follower arm 96 terminating at its distal end in a follower roller 98. As will be described in more detail hereinafter, at certain portions during its travel about the sorting table 48, the roller arm is depressed in the direction indicated by arrow 100, causing cylinder 84' to rotate in the clockwise direction (as viewed in FIG. 6). As all of the cylinders 84 are tied together by chain 90, each of the cylinders 84 will thus rotate simultaneously in the clockwise direction. Such rotation, in turn, causes each arm 80 to rotate in the clockwise direction to the position illustrated in broken line in FIG. 6. The cylinders 84 are spring loaded so that in the absence of a force applied to arm 96, the arms will close together to the position shown in full line in FIG. 6. As will be explained in more detail hereinafter, the movement of the arms 80 causes the opening of an elastic band which is placed over hooks 82 when the arms 80 are collapsed together. The worker W is then able to place a bunch of broccoli B into the opened elastic band, as illustrated in FIG. 3.

Figure 8:
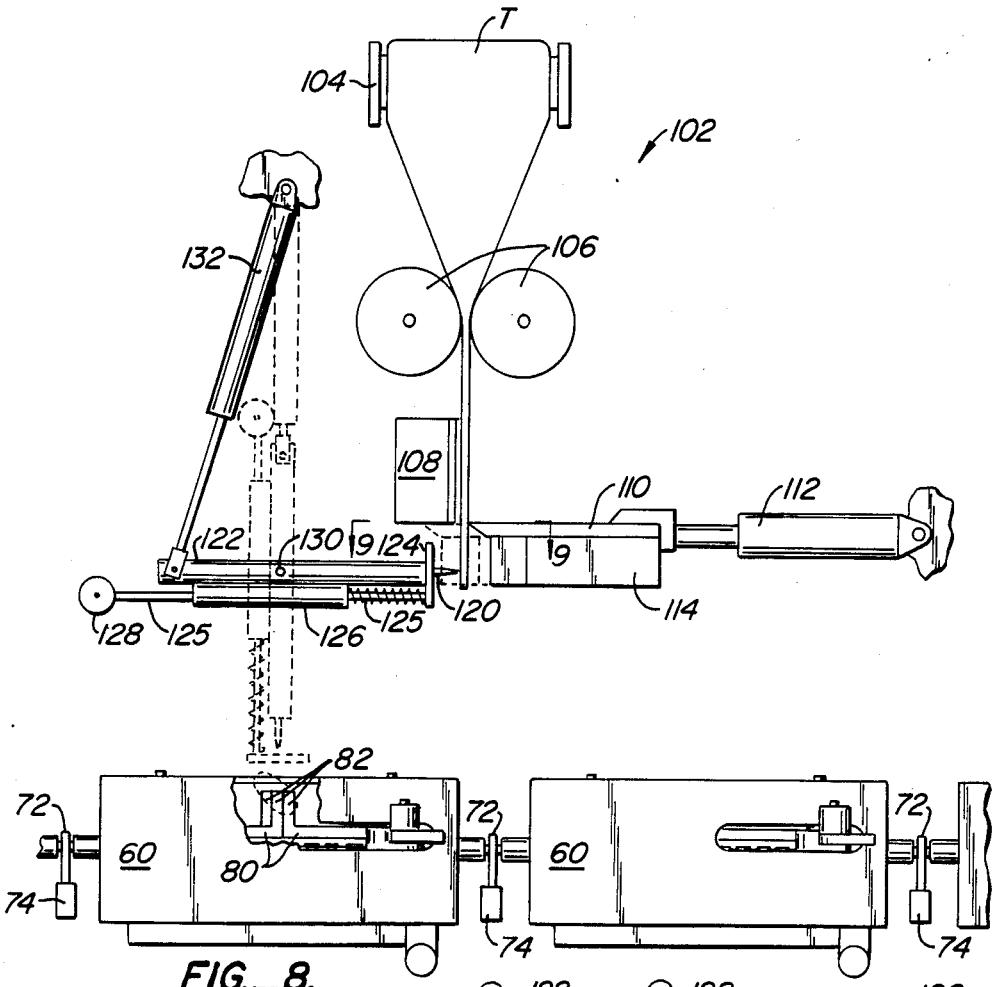
FIG. 8 is a schematic view illustrating the elastic band dispensing mechanism of the present invention in relation to the banding frames.
Figure 9:
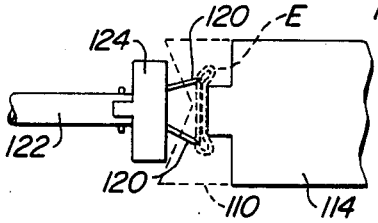
FIG. 9 is a detail view taken along line 9—9 of FIG. 8.

Referring now to FIGS. 8–10, a mechanism 102 for placing elastic bands E on to hook portions 82 of spreadable arms 80 will be described in detail. The mechanism 102 is mounted generally above banding frames 60 so that they may pass by underneath. The mechanism 102 includes a first roller spool 104 and a pair of pinch rollers 106 for feeding a continuous length of elastomeric tubing T. The tubing T is usually of the type having a flat or collapsed profile when it is stored. The tubing is generally fed from a storage location (not illustrated) over the first spool 104 with the flat plane of the tubing lying flat against the spool. The tubing then passes through rollers 106 which press the tubing against the edges of the flat plane so that the tubing is flattened across in the perpendicular plane. Such a feed mechanism is used because flat tubing which has been stored for some time under compressed conditions is frequently difficult to open. By running the tubing through the rollers in the manner just described, the tubing is opened and the tendency for the tubing to adhere to itself is minimized.

At least one of the rollers 106 is driven in order to feed the tubing downward passed an anvil block 108. Cutting blade 110 is reciprocatably mounted on a pneumatic cylinder 112. Blade 110 is capable of reciprocating between the position shown in full line and an extended position shown in broken line in FIG. 8. Thus, the blade 110 and the anvil 108 can together shear off a section of tubing T which lies below the anvil. The resulting sheared section can then be used as an elastic band, as will now be described.

The blade 110 includes a press block 114 on its lower surface. The press block 114 travels just behind the leading edge of the blade 110 and contacts the segment of tubing T which is sheared by the blade, causing that segment to move leftward in FIGS. 8 and 9. The segment of tubing is thus pressed onto a pair of snagging pins 120. It is preferred that the press block 114 have the profile illustrated in FIG. 9 so that the snagging pins 120 penetrate only one layer of the elastic band E. Moreover, it has been found that the orientation of the snagging pins 120 illustrated in FIG. 9, with the pins converging outward approximately 15°–30°, is particularly effective in both snagging the elastic band E and thereafter placing the band on the spreadable hooks 82. It is also preferred that the blade 110 have the profile illustrated in FIG. 10 which provides a particularly clean cut of the tubing T.

The snagging hooks 120 are mounted on a pivotable arm 122. In the preferred embodiment, a push-off plate 124 is provided to eject the elastic bands E onto the spreadable hooks 82. The plate 124 is reciprocatably mounted on a rod 125 in a linear bearing 126. The linear bearing 124 is mounted on one side of the arm 122, a compressed spring 127 is placed between the bearing 126 and plate 124 to urge the plate away from the bearing. The plate, however, is held in a retracted position by a cam follower 128 which engages a cam surface 129 (FIG. 10). The cam surface is shaped to push the push-off plate 124 forward as the arm 122 is rotated in the clockwise direction, as illustrated.

Figures 10A, 10B, 10C:
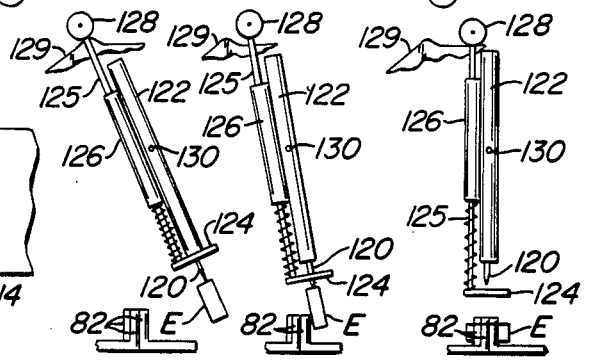
FIGS. 10A–10C illustrate the placement of an elastic band on the spreadable pins of a banding frame by the band dispensing mechanism of the present invention.

The pivotable arm 122 is mounted on fixed pivot 130 and attached at its other end to an actuating cylinder 132. As illustrated in full line in FIG. 8, when the actuating cylinder is in its fully extended position, the pivotable arm 122 is generally horizontal and pins 120 are adjacent tubing T on the side opposite from the blade 110. After elastic band E has been pushed onto the snagging pins 120 by block 114, as illustrated in FIG. 9, the blade 110 and block 114 are retracted by cylinder 112, and the pivotable arm 122 lowered by retracting cylinder 132. The pivotable arm 122 is fully lowered to the position shown in broken line in FIG. 8 so that the elastic band E is extending downward. Passage of the banding frame 60 beneath the pivotable arm 130 is precisely timed so that the hook portions 82 reach the elastic band E just as it arrives on the arm 122. As the hooks 82 pass beneath the arm 122, the push-off plate 124 is extended downward by interaction of cam follower 128 and cam surface 129, as described above. In this way, the elastic band E is freed from the snagging pins 120 just as the hooks 82 arrive to pick it up. The push-off plate 124 also momentarily covers the hooks 82 to prevent the band E from being dislodged as the hooks are rotated away. This action is illustrated in FIGS. 10A–10C.

The band placement mechanism 102 is preferably located beneath the second axial conveyor 46 (as illustrated in FIG. 1) where it does not interfere with the workers standing around the periphery of the sorting table 48. This location is illustrated in detail in FIG. 12 where the placement mechanism 102 is illustrated by box 140 in broken line.

Figure 12:
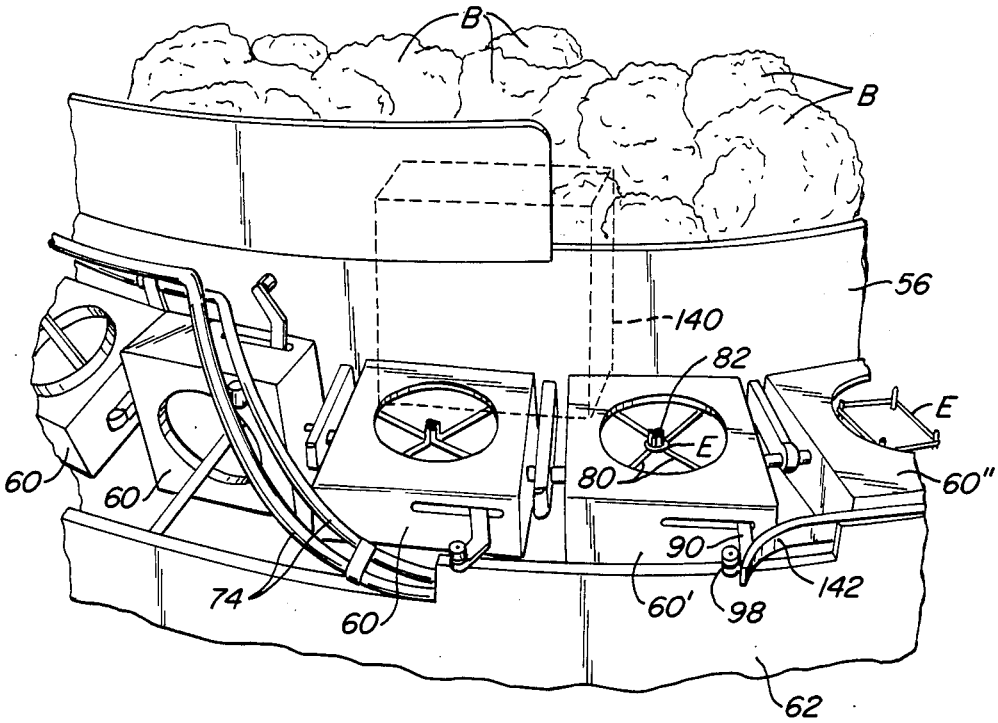
FIG. 12 illustrates the broccoli ejection mechanism of the present invention.

After the bands E have been placed on hooks 82, as illustrated on banding frame 60' in FIG. 12, the follower roller 98 on follower arm 96 engages rail 142 mounted on skirt 62. The rail 142 depresses the follower arm 96 in the direction of arrow 100 (FIG. 6) causing all four arms 80 to open, thus stretching the band E open, as illustrated on banding frame 60" in FIG. 12. The banding frames 60 then complete rotation with the rotatable table 48 until they again reach the location beneath second axial conveyor 46. During this period of travel, workers standing around the periphery of the sorting table 48 are able to place bunches of broccoli into the open bands on the banding frames. It is also possible to provide a second band placement and discharge mechanism at a location directly opposite the first location. Use of two band placement and discharge mechanisms will double the capacity of the system.

Figure 11:
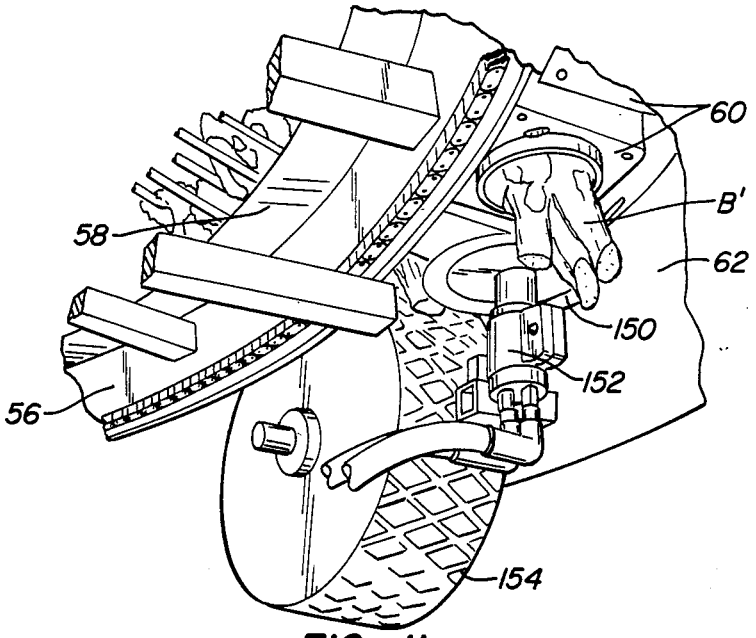
FIG. 11 illustrates the stalk cutting mechanism of the present invention.
Figure 13:
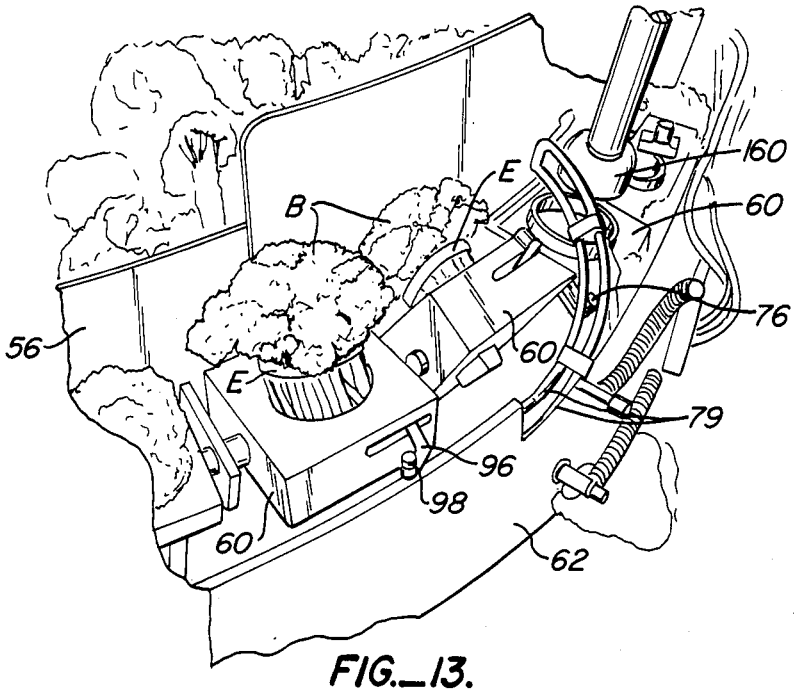
FIG. 13 illustrates the spreadable pin opening mechanism of the present invention.

Referring now to FIGS. 11 and 13, as the banding frames 60 again approach the banding mechanism 102, the track 142 terminates and follower arm 96 is free to spring back to the closed position of arms 80. It will be appreciated that the arms 80 do not fully close, but rather collapse into the bunch of broccoli B so that tension is released from the elastic band E. Simultaneously with releasing the follower arm 96, a portion of the broccoli stalks projecting downward from the banding frame 60 are cut to make the size of the bunches more uniform. As illustrated in FIG. 11, a circular, horizontal blade 150 is mounted on a hydraulic motor 152. The blade 150 is fixed relative to the travel of the banding frames 60, so that the stalks are presented to the blade and cut as the sorting table 48 rotates. After being cut, the broccoli bunches encounter an ejection roller 154 which is positioned to push the bunches of broccoli upward to release the elastic bands entirely from the hooks 82 on arms 80.

Referring now to FIG. 13, after the broccoli B has been partially ejected by the ejection roller 150, the banding frame 60 are overturned by rails 79. The rails 79 follow a partially helical path, causing rollers 76 to turn over the banding frame 60. After the banding frame 60 has been completely turned over, the broccoli B will usually fall downward onto discharge conveyor 50. To make sure that the broccoli B is fully ejected, an ejection plunger 160 is provided, as illustrated in FIG. 13. Once the banding frames 60 have been cleared, they are turned back over into their upright positions, as illustrated in FIG. 12, and the bands may then be placed over the hooks 82, as described previously.

The banded broccoli B" carried away on discharge conveyor 50 may then be placed in cartons by workers standing elsewhere on the rear segment 16 of mobile frame 12. Conveniently, storage space for empty cartons and additional work spaces may be provided on the mobile frame 12. Such work spaces are well known in the art and, for the sake of clarity of explanation, not included in the present drawings and discussion.

Although the foregoing invention has been described in some detail by way of illustration and example for purposes of clarity of understanding, it will be obvious that certain changes and modifications may be practiced within the scope of the appended claims.

What is claimed is:

1. An apparatus for banding cut produce, said apparatus comprising:

a frame;

a sorting table rotatably mounted on said frame;

means for rotating said table;

means mounted on said frame for continuously feeding produce to said sorting table;

a plurality of banding frames mounted on the rotatable table so that they are spaced-apart about its periphery, each frame including a plurality of spreadable pins for receiving and opening individual bands so that bunches of produce may be placed therein;

means mounted on said frame for placing individual bands on the spreadable pins of the banding frames, whereby the pins may be spread to open the band and bunches of cut produce may be manually selected from the sorting table and placed into the opened bands as the table rotates;

means for opening and collapsing the spreadable pins;

means for turning the banding frames upside down when the spreadable pins are collapsed so that the banded produce will fall therefrom; and means for collecting the banded produce as it falls from the banding frames.

2. An apparatus as in claim 1, wherein the frame is a mobile frame.

3. An apparatus as in claim 1, wherein the means for feeding produce to the sorting table is a conveyor belt having a discharge end above the table.

4. An apparatus as in claim 1, further including means for ejecting the banded produce downward from the banding frames.

5. An apparatus as in claim 1 wherein the means for collecting the banded produce includes a discharge conveyor located beneath the rotatable table.

6. An apparatus for collecting and banding cut produce, said apparatus comprising:

an elongate mobile frame having a forward end and a rearward end which together define an axis;

an axial collection conveyor having a discharge end;

at least one collection conveyor transverse to the axis and feeding the axial collection conveyor upstream of the discharge end;

a sorting table rotatably mounted on said frame at the discharge end of the axial collection conveyor;

an axial discharge conveyor located beneath the sorting table;

a plurality of banding frames mounted about the periphery of the sorting table, each frame including a plurality of spreadable pins capable of receiving and opening an elastic band, said frame being pivotally mounted so that they may be turned upside down over the discharge conveyor;

means for opening and collapsing the spreadable pins in each frame as the sorting table is rotated past preselected locations, the pins being collapsed when the frame passes over the discharge conveyor; and means for turning each banding frame upside down as it passes over the discharge conveyor so that the banded produce will fall out onto said discharge conveyor.

7. An apparatus as in claim 6, wherein the mobile frame includes means for self-propulsion.

8. An apparatus as in claim 6, wherein the mobile frame is articulated having a forward section and a rearward section.

9. An apparatus as in claim 8, wherein the axial collection conveyor includes a first section on the forward section and a second section on the rearward section.

10. An apparatus as in claim 9, having two transverse conveyors mounted on either side of the forward end of the forward section of the elongate frame so that said transverse conveyors discharge onto the first section of the axial collection conveyor.

11. An apparatus as in claim 6, further comprising means for ejecting banded produce from the banding frame when the pins are collapsed and the frame is turned upside down over the discharge conveyor.

12. An apparatus as in claim 6, further comprising means for automatically placing elastic bands onto the spreadable pins when they are collapsed.

13. An apparatus as in claim 12, wherein the means for placing elastic bands comprises:

means for feeding a continuous tube of elastic tubing in a first direction on a cutting plane;

a blade;

means for reciprocating the blade in a second direction substantially perpendicular to the first direction;

a pivotable arm;

at least two snagging pins mounted on the pivotable arm for piercing the bands, said pins being located across from the blade on the opposite side of the cutting plane when the arm is in a first position, whereby a rubber band is cut from the continuous tube and carried onto the snagging pins as the blade is reciprocated; and means for pivoting the arm to transport the rubber band to the spreader pins.

14. An apparatus for placing elastic bands on spreader pins, said apparatus comprising:

means for feeding a continuous tube of elastic tubing in a first direction on a cutting plane;

a blade;

means for reciprocating the blade in a second direction substantially perpendicular to the first direction;

a pivotable arm;

at least two snagging pins mounted on the pivotable arm for piercing the bands, said pins being located across from the blade on the opposite side of the cutting plane when the arm is in a first position, whereby a rubber band is cut from the continuous tube and carried onto the snagging pins as the blade is reciprocated; and means for pivoting the arm to transport the rubber band to the spreader pins.

15. An apparatus as in claim 14, wherein the means for feeding the elastic tubing includes a pair of opposed rollers, at least one of which rollers is automatically driven to advance the elastic tube.

16. An apparatus as in claim 15, wherein the means for feeding the elastic tubing is arranged so that tubing having a flat cross-section is passed through the rollers with the flat plane of the tubing oriented perpendicularly to the rollers.

17. An apparatus as in claim 16, further comprising an anvil block positioned to provide shearing of the tubing by the reciprocating blade.

18. An apparatus as in claim 16, further comprising a push block mounted to reciprocate with the blade and to push the tubing into the snagging pins.

19. An apparatus as in claim 14, wherein the snagging pins are resiliently mounted on the pivotable arm.

20. An apparatus as in claim 19, wherein the pins are pivotally mounted.

* * * * *